US006217253B1

(12) United States Patent
Eslambolchi et al.

(10) Patent No.: US 6,217,253 B1
(45) Date of Patent: Apr. 17, 2001

(54) RIBBON MARKING TOOL

(75) Inventors: Hossein Eslambolchi, Basking Ridge, NJ (US); John Sinclair Huffman, Conyers, GA (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 09/342,448

(22) Filed: Jun. 29, 1999

(51) Int. Cl.[7] ..... E01C 23/16
(52) U.S. Cl. ..... 404/93; 116/209; 116/DIG. 14
(58) Field of Search ..... 404/93, 94; 116/209, 116/DIG. 14, 211; 221/30, 32

(56) References Cited

U.S. PATENT DOCUMENTS 4,317,696 * 3/1982 Hutchinson et al. ..... 404/94
4,824,516 * 4/1989 Ishihara et al. ..... 404/94
4,923,559 * 5/1990 Kennedy et al. ..... 404/94
4,936,485 * 6/1990 Downing ..... 404/93
5,453,320 * 9/1995 Harper et al. ..... 404/94

* cited by examiner

*Primary Examiner*—William Neuder
(74) *Attorney, Agent, or Firm*—Robert T. Canavan; Robert B. Levy

(57) ABSTRACT

A ribbon marking tool (10) for dispensing a length of warning tape (14) along the ground above a buried conveyance tool includes a housing (20) within which a roll of warning tape (36) is mounted for rotation. A mechanism (32) within the housing serves to feeds the tape out through the housing and to staple the tape to the ground and to sever the tape once a sufficient length of tape is dispensed.

14 Claims, 4 Drawing Sheets

RIBBON MARKING TOOL

TECHNICAL FIELD

This invention relates to a tool for marking the location of a buried conveyance, such as a pipe or cable.

BACKGROUND ART

Many utilities bury their pipes and cables (hereinafter, "conveyances") underground, both for cosmetic reasons, as well as to protect such conveyances from the elements. The utility undertaking burial records the location of the burial on a map to facilitate finding the conveyance at a later time. Contractors seeking to excavate in the vicinity of a conveyance will want to know the precise location of the conveyance to avoid damage thereto. While maps may provide a general indication of the location of the buried conveyance, most utilities invariably will dispatch a technician to physically locate the conveyance, typically using electromagnetic signaling for this purpose. Upon physically locating the conveyance, the technician will traditionally spray a water-soluble paint on the ground above the conveyance. Depending on weather and the extent of ground traffic, such marks may last two to three days. If excavation will occur for any longer duration, the technician must replenish the previously sprayed markings, often necessitating another visit to the job site.

In some instances, spray painting the markings may not suffice, requiring a more permanent method of indicating the location of the buried conveyance. To that end, utilities have resorted to placing metal flags at spaced intervals along the path of the buried conveyance. While the flags are more durable than the sprayed markings, the use of flags incurs disadvantages as well. Generally, the flags are simply pushed into the ground, allowing relatively easy removal and transfer to a different location. Unless the excavating contractor is specifically aware of the original location of the flags, the contractor may simply not notice any change in their location and presume it is safe to excavate in absence of the flags when in fact, buried conveyances exist. Moreover after deployment, the technician must remove the flags to avoid damage to lawn mowers and other similar equipment.

Thus, there is a need for a technique that provides a more permanent marking method to identify buried conveyances.

BRIEF SUMMARY OF THE INVENTION

Briefly, the present invention concerns a marking tool for dispensing a length of warning tape and for securing the tape to the ground above a buried conveyance. The tool includes a housing within which a roll of warning tape is mounted for rotation. A dispensing mechanism feeds the tape through the housing along a path overlying an opening in the housing in communication with the ground. A staple-driving mechanism lies within the housing opposite the opening but is separated therefrom by the length of tape fed by the dispensing mechanism. A cutting mechanism lies along the path of tape travel for severing the tape once the staple driving mechanism drives a staple through the tape to secure it to the ground.

DETAILED DESCRIPTION

Figure 1:
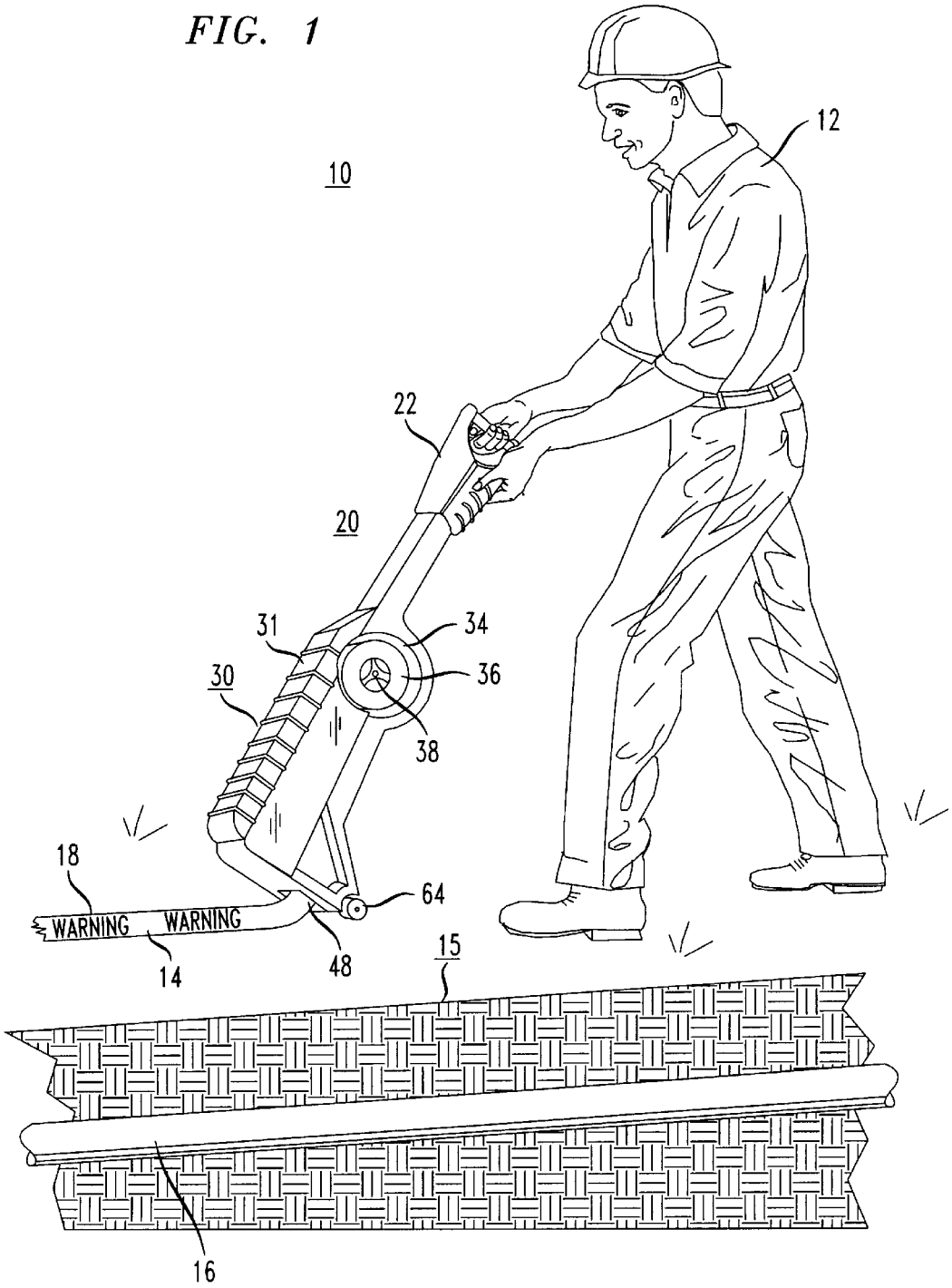
FIG. 1 depicts a ribbon marking tool in accordance with the invention for use by an operator for dispensing a length of warning tape above a buried utility conveyance.

FIG. 1 shows a ribbon-marking tool 10 in accordance with the invention for use by a operator 12 to dispense a length of flexible warning tape 14 along the ground 15 above a buried utility conveyance 16, such as a pipe or cable. In practice, the warning tape 14, typically made from plastic or MYLAR, carries indicia 18, in the form of a message warning of the existence of the buried conveyance 16. For example, the indicia 18 typically includes both a warning message, such as "WARNING—BURIED UNDERGROUND CONVEYANCE", and also include the identity of the utility responsible for the conveyance, as well as a telephone number or address for contacting the utility, although the later is not always necessary.

Figure 2:
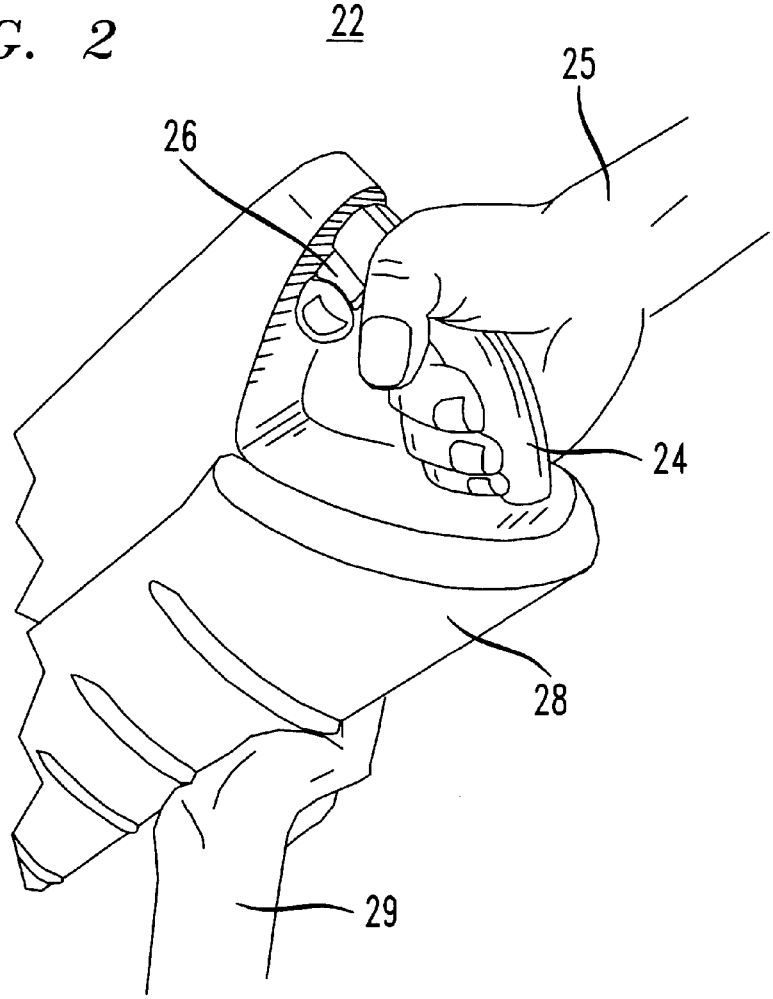
FIG. 2 depicts a portion of the tool of FIG. 1 showing the tool handle.

The ribbon-marking tool 10 of the invention comprises a housing 20 of a material such as plastic or aluminum. At a first or upper end of the housing 10 is a handle 22 which, as best illustrated in FIG. 2, includes a first pistol grip 24 for engagement by a first hand 25 of the operator 12 of FIG. 1. The grip 24 carries a trigger switch 26, which, as described hereinafter, serves to control the dispensing, stapling and cutting of the warning tape 14 by the tool 10. Additionally, the handle 22 includes a second grip 28 in the form of a foam rubber collar for engagement by the second hand 29 of the operator 12 of FIG. 1.

As best seen in FIG. 1, the housing 20 includes an enlarged lower portion 30 whose interior is accessible through a hinged door 31 to allow entry into the housing to a mechanism 32 (see FIG. 3) that serves to dispense, staple and cut the warning tape 14. In the illustrated embodiment, the door 31 has a circular opening 34 sized to receive a roll 36 on which a length of the warning tape 14 is wound. At the center of the opening 34 is a spindle 38 on which the warning tape roll 36 rotates to permit the tape to feed into the mechanism 32 of FIG. 3. Note that the opening 34 for receiving the tape roll 36 could lie in the lower housing portion 30 adjacent to the door 31, rather than extend through the door itself.

Figure 3:
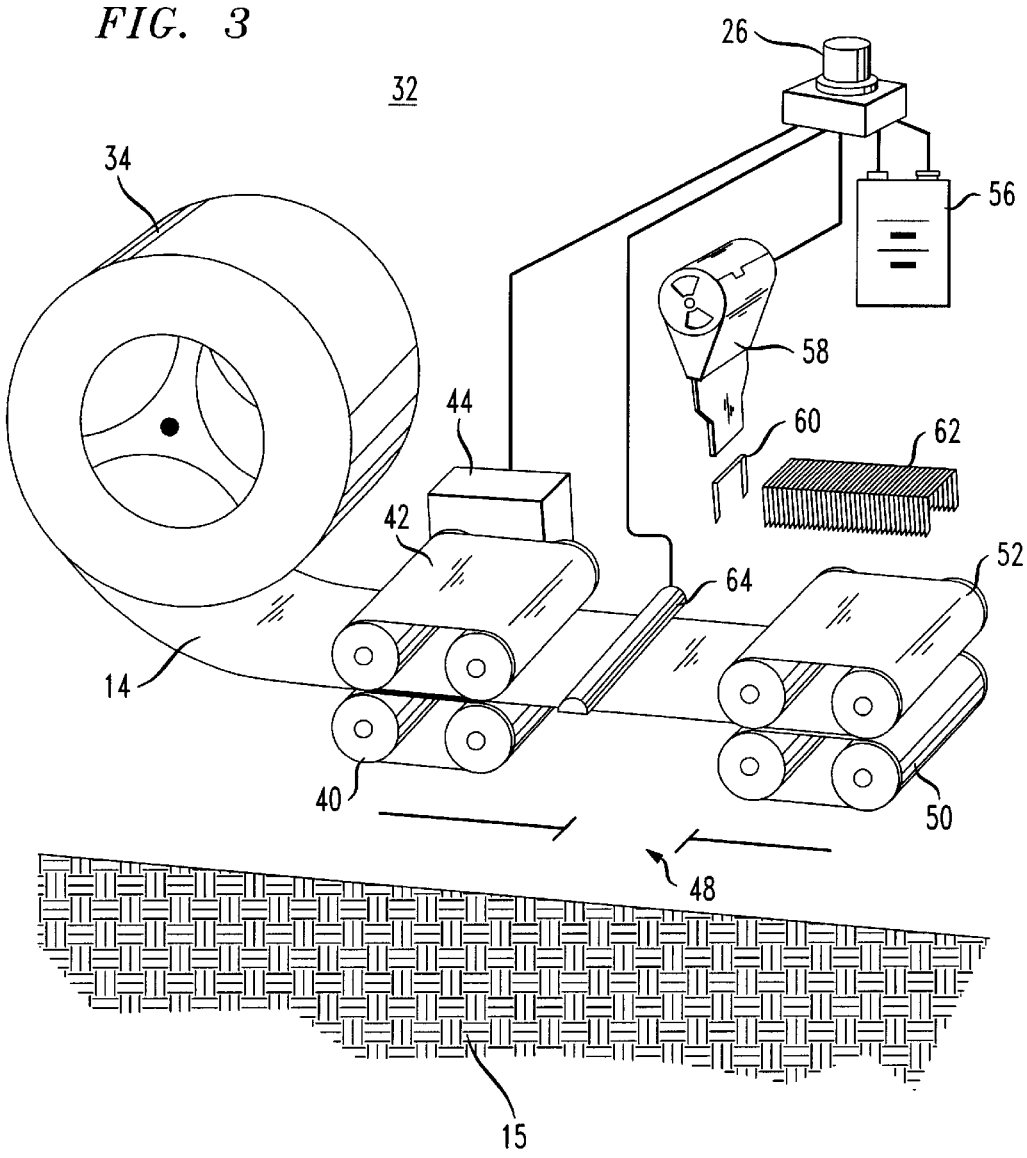
FIG. 3 is block diagram of the mechanism within the tool of FIG. 1 for dispensing, stapling and cutting the warning tape.

Referring to FIG. 3, the mechanism 32 for dispensing, stapling and cutting the warning tape 14 includes first upper and lower warning tape engagement means 40 and 42, respectively. In the illustrated embodiment, the first upper and lower warning tape engagement means 40 and 42 comprise upper and lower conveyor belts for engaging the top and bottom surface, respectively, of the warning tape 14 as it is fed from the roll 36. A motor 44 drives the conveyor belts 40 and 42 in opposite directions to advance the warning tape 14 past a window (opening) 48, which as best shown in FIG. 1, lies in the base of the lower housing portion 30 in communication with the ground 15.

Second upper and lower engagement means 50 and 52, typically comprised of upper and lower conveyor belts, respectively, lie adjacent to the window 48 opposite the first upper and lower conveyor belts 40 and 42, respectively. Upon actuation of the trigger switch 26, a battery 56 powers the motor 44 to drive the first upper and lower conveyor belts 40 and 42 in opposite directions to advance the warning tape 14 across the window 48 and into engagement with the second upper and lower conveyor belts 50 and 52. Unlike the first upper and lower conveyor belts 40 and 42 that are motor-driven, the second upper and lower conveyor belts 50 and 52 are free spinning, and simply serve to engage the free-end of the warning tape 14, thereby maintaining the warning tape somewhat taut across the window.

The trigger switch 26 also couples the battery 56 to a motor-driven hammer 58 overlying the window 48 but separated therefrom by the warning tape 14. When powered by the battery 56, the motor-driven hammer 58 serves to drive a first staple 60 within a stack of staples 62 through that portion of the tape 14 overlying the window 48 to secure the tape to the ground 15. A resistance heater bar 64 lies adjacent to the first upper and lower conveyor belts 40 and 42 for contacting the warning tape 14 advanced by the conveyor belts across the window 48. The trigger switch 26 couples the heater bar 64 to the battery 56 so that upon actuation of the switch, the battery excites the heater bar, which in turn, melts the warning tape 14 to sever it from the roll 44.

In operation, the operator 12 holds the tool 10 with the window 48 in the lower portion 30 of the housing 20 opposite the ground 15. To this, end, the lower housing portion 30 typically includes a roller 64 to allow the operator 12 to roll the housing 20 along the ground 15 to maintain the window 48 in a substantially fixed relationship thereto. Once the operator 12 has positioned the tool at a location above the buried conveyance 16 of FIG. 2, the operator operates the trigger switch 26 of FIGS. 2 and 3 to actuate cause the motor-driven hammer 58 of FIG. 3. Once actuated, the motor-driven hammer 58 drives staple 60 of FIG. 3 through the warning tape 14 and into the ground 15 of FIG. 1, thereby dislodging the free end of the warning tape from the second upper and lower conveyor belts 50 and 52.

With the warning tape 14 now stapled to the ground, the operator 12 will operate the trigger switch 26 of FIGS. 2 and 3 to actuate the first upper and lower conveyor belts to allow feeding of the warning tape 14 through the window 48 and on the ground 15 along the path of the buried conveyance 16 of FIG. 1 as the operator walks therealong. While as the warning tape 14 is dispensed, the operator 12 will actuate the trigger switch 26 to actuate the motor-driven hammer 58 to drive an additional staple 60 into the tape. Once a sufficient length of tape 14 is dispensed, the operator 12 will actuate the trigger switch 26 and actuate the heater bar 64 to cut the warning tape 14 proximate the additional staple.

Rather that utilize the first upper and lower conveyor belts 40 and 42 to feed the warning tape 14 past the window, a first pair of laterally spaced sprocket wheels 66 and 68, driven by the motor 44 in unison, could be substituted, provided the warning tape 14 includes first and second sprocket-engaging apertures 70 and 72 for engaging the sprocket wheels. Similarly, a second pair of laterally spaced, free spinning sprocket wheels could be substituted for the upper and lower conveyor belts 50 and 52. A pair of laterally spaced guides 78 and 80 directs the warning tape 14 from the first pair of sprocket wheels 66 to the second pair of sprocket wheels 74 and 76.

Figure 4:
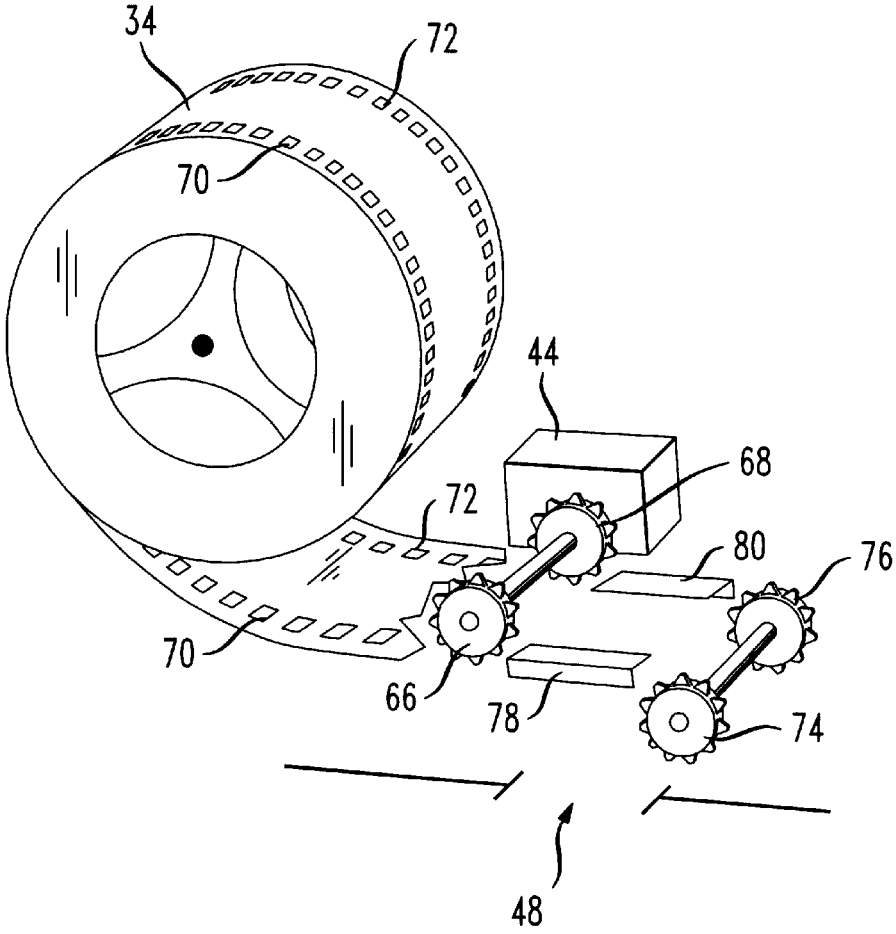
FIG. 4 shows an alternate preferred embodiment of a portion of the mechanism for dispensing, stapling and cutting the warning tape.

The warning tape feed arrangement of FIG. 4 operates to feed the warning tape 14 past the window 48 once the motor 44 is actuated to drive the first pair of sprocket wheels 66 and 68 so they engage the sprocket-engaging apertures 70 and 72. As the warning tape 14 advances, the guides 78 and 80 feed the tape into warning tape into engagement with the sprocket wheels 74 and 76.

The foregoing describes a ribbon marking for dispensing a length of warning tape to marking the location of a buried conveyance, such as a pipe or cable.

What is claimed is:

1. A tool for dispensing a length of warning tape along the ground above the path of a buried conveyance, comprising:

a housing for rotatably mounting a roll of tape containing warning indicia;

means within the housing for feeding a length of warning tape past a window in the housing in communication with the ground;

means within the housing opposite the window for driving a staple through the to secure the tape to the ground;

means adjacent to the feeding means for cutting the warning tape; and actuating means for actuating the feeding means, the staple driving means and the cutting means.

2. The tool according to claim 1 wherein the feeding means comprises:

first and second conveyor belts situated on a first side of the window for engaging first and second major surfaces, respectively, of the warning tape;

a motor for driving the first and second conveyor belts in opposite directions to displace the tape; and third and fourth conveyor belts which are free-spinning and are situated on a second side of the window opposite the first and second conveyor belts for engaging a free end of the warning tape displaced by the first and second conveyor belts.

3. The tool according to claim 1 wherein the feeding means comprises:

first and second sprocket wheels situated on a first side of the window for engaging first and second sprocket apertures in the warning tape, respectively;

a motor for driving the first and second sprocket wheels in unison;

third and fourth sprocket wheels which are free-spinning and are situated on a second side of the window opposite the first and second conveyor belts for engaging a free end of the warning tape displaced by the first and second sprocket wheels.

4. The tool according to claim 1 wherein the staple driving means comprises a motor-driven hammer.

5. The tool according to claim 1 wherein the cutting means comprises a resistance heater bar.

6. The tool according to claim 1 wherein the actuating means comprises a trigger switch carried by the housing for individually coupling the feeding means, the stapling means, and the cutting means to a source of electrical power.

7. The tool according to claim 1 wherein the housing is fabricated substantially from plastic.

8. The tool according to claim 1 wherein the housing is fabricated substantially from aluminum.

9. The tool according to claim 1 wherein the housing includes a hinged door through which access is gained into the housing interior.

10. The tool according to claim 1 wherein the door has an opening therethrough for receiving a roll of warning tape.

11. A method for warning of the existence of a utility conveyance buried below ground, comprising the steps of:

positioning a portion of a warning tape in proximity with the ground below which the conveyance is buried;

securing said tape portion to the ground by driving a first staple through the ground;

dispensing a length of tape along the path of the conveyance;

driving at least one additional staple through the tape; and cutting the tape proximate the additional staple.

12. The method according to claim 11 wherein the step of dispensing the length of warning tape comprises the step of contacting first and second major surfaces of the tape with first and second conveyor belts driven in opposite directions.

13. The method according to claim 11 wherein the step of dispensing the length of warning tape comprises the step contacting the tape with a pair of sprocket wheels driven in unison to engage sprocket apertures in the tape.

14. The method according to claim 11 wherein the step of cutting the tape includes the step of contacting the tape with a resistance heater to melt the tape.

* * * * *